US007305754B2

(12) United States Patent
Sekiya et al.

(10) Patent No.: US 7,305,754 B2
(45) Date of Patent: Dec. 11, 2007

(54) METHOD OF MANUFACTURING CHIP RESISTOR

(75) Inventors: Kazuma Sekiya, Tokyo (JP); Toshiaki Takahashi, Tokyo (JP)

(73) Assignee: Disco Corporation, Tokyo (JP)

( * ) Notice: Subject to any disclaimer, the term of this patent is extended or adjusted under 35 U.S.C. 154(b) by 512 days.

(21) Appl. No.: 10/990,395

(22) Filed: Nov. 18, 2004

(65) Prior Publication Data

US 2005/0118774 A1 Jun. 2, 2005

(30) Foreign Application Priority Data

Nov. 27, 2003 (JP) ..... 2003/397214

(51) Int. Cl.
*H05B 3/00* (2006.01)

(52) U.S. Cl. ..... 29/611; 29/610.1; 29/619; 29/620; 29/621; 338/25; 338/48; 338/195; 338/307; 338/309; 438/382; 438/385

(58) Field of Classification Search ..... 29/611, 29/610.1, 619–621; 338/25, 48, 195, 307, 338/309; 438/382, 385
See application file for complete search history.

(56) References Cited

U.S. PATENT DOCUMENTS 4,805,296 A * 2/1989 Jinda et al. ..... 29/620
5,466,484 A * 11/1995 Spraggins et al. ..... 438/385
5,966,577 A * 10/1999 Abe ..... 399/320

FOREIGN PATENT DOCUMENTS

JP 8-204063 8/1996

* cited by examiner

*Primary Examiner*—A. Dexter Tugbang
*Assistant Examiner*—Tim Phan
(74) *Attorney, Agent, or Firm*—Wenderoth, Lind & Ponack, L.L.P.

(57) ABSTRACT

In manufacturing a chip resistor by dividing a chip resistance substrate which includes an insulator, resistance film formed on a surface of the insulator, and a plurality of conductive strips disposed on the resistance film at fixed intervals, grooves are formed by removing a predetermined width of the resistance film including at least second prescribed severing lines. After forming the grooves, the chip resistance substrate is severed in longitudinal and lateral directions along first prescribed severing lines for dividing the conductive strips into two parts and the second prescribed severing lines perpendicular to the first prescribed severing lines so as to produce discrete chip resistors.

5 Claims, 6 Drawing Sheets

METHOD OF MANUFACTURING CHIP RESISTOR

CROSS REFERENCE TO RELATED DOCUMENT

This application claims priority to Japan Patent Application No. 2003-397214, filed Nov. 27, 2003.

BACKGROUND OF THE INVENTION

1. Field of the Invention

The present invention relates to a method of manufacturing a chip resistor.

2. Related Art

A chip resistor 100 illustrated in FIG. 10, for example, is manufactured by severing in longitudinal and lateral directions a chip resistance substrate which is formed by: coating the upper surface of an insulating substrate 101 made from an insulator such as alumina ceramics with resistance film 102; and providing conductive strips 103 having a predetermined width on the resistance film 102. The chip resistor 100 has a predetermined size in accordance with a standard (e.g., 0.6 mm×0.3 mm or 0.4 mm×0.2mm) and predetermined resistance (e.g., in the range from 1 ohm to 1 mega-ohm). The resistance film 102 and the conductive strips 103 are formed by screen printing or other methods (see JP-A-08-204063, for example).

However, as the chip resistor has errors of resistance in some cases, its actual resistance is set at a lower value than the desired value. As a result, fine adjustment is required to be made for obtaining the desired resistance by irradiating a laser beam to the resistance film after dividing the chip resistance substrate into discrete chip resistors to partially remove the resistance film. This process lowers the productivity of the chip resistors.

Moreover, while large numbers of the chip resistance substrates are produced at a low cost by screen printing or other methods, processes such as adjusting the film pressure of the resistance film and controlling the amount of conductive powder to be mixed into resin constituting the resistor film such as carbon powder to control resistance values are required so that various chip resistors having a wide range of resistance values in conformity with standards can be produced. Accordingly, it is necessary to design a wide variety of resistance films and also control the inventory and manufacture of the chip resistors for each type of the resistance films. This also lowers the productivity of the chip resistors.

SUMMARY OF THE INVENTION

Therefore, in order to solve the above problems, it is an object of the present invention to provide a method of manufacturing a chip resistor with enhanced flexibility and efficiency.

For achieving the above object, provided according to the present invention is a method of manufacturing a chip resistor by dividing a chip resistance substrate which includes an insulating substrate, resistance film formed on a surface of the insulating substrate, and a plurality of conducting strips for partitioning the resistance film at required intervals, wherein prior to a division step in which the chip resistance substrate is severed in longitudinal and lateral directions along first prescribed severing lines to divide the conductive strips into two parts and second prescribed severing lines perpendicular to the first prescribed severing lines so as to form discrete chip resistors, a resistance film width adjustment step is carried out in which grooves are formed by removing a predetermined width of the resistance film including at least the second prescribed severing lines so as to adjust the width of the resistance film by the two adjoining grooves.

A cutting device that can be used in the resistance film width adjustment step includes at least a chuck table for holding a workpiece, a groove forming unit containing a cutting blade which has the predetermined width and cuts the workpiece held by the chuck table, and driving units for relatively shifting the chuck table and the groove forming unit. When this cutting device is used in the resistance film adjustment step, the grooves having the predetermined width can be formed by removing at least the resistance film including the second prescribed severing lines by means of the cutting blade while relatively shifting the chuck table and the groove forming unit by means of the driving units.

A cutting device that can be used in the division step includes at least a chuck table for holding a workpiece, a severing unit containing a cutting blade which cuts and severs the workpiece held by the chuck table, and driving units for relatively shifting the chuck table and the severing unit. When this cutting device is used in the division step, the chip resistance substrate held by the chuck table after the resistance film width adjustment step can be severed along the first prescribed severing lines and the second prescribed severing lines by means of the cutting blade so as to be divided into discrete chip resistors while relatively shifting the chuck table and the severing unit by means of the driving units.

When a cutting device is used which includes at least a chuck table for holding a workpiece, a groove forming unit containing a first cutting blade which has the predetermined width and cuts the workpiece held by the chuck table, a severing unit containing a second cutting blade which cuts and severs the workpiece, and driving units for relatively shifting the chuck table, the groove forming unit and the severing unit, the width of the resistance film is adjusted by removing at least the resistance film including the second prescribed severing lines by means of the first cutting blade while relatively shifting the chuck table holding the chip resistance substrate and the groove forming unit by means of the driving units in the resistance film width adjustment step, and the chip resistance substrate held by the chuck table after the resistance film width adjustment step is severed along the first prescribed severing lines and the second prescribed severing lines by means of the second cutting blade so as to be divided into discrete chip resistors while relatively shifting the chuck table and the severing unit by means of the driving units in the division step.

The insulating substrate may be made from a silicone substrate coated with oxide film.

In the resistance film width adjustment step, the resistance film having a plurality of different widths may be formed on a single chip resistance substrate. The resistance film may have a different width for each chip resistance substrate.

In the present invention, the grooves are formed by removing the predetermined width of the resistance film including the second prescribed severing lines before the chip resistance substrate is severed along the first prescribed severing lines and the second prescribed severing lines so as to be divided into discrete chip resistors. By freely controlling the removal amount of the resistance film through the adjustment of the width of the grooves, the resistance value of the chip resistor to be produced by the subsequent severing process can be freely and easily controlled at the stage of the chip resistance substrate. This eliminates the necessity of adjusting resistance values for respective chip resistors, and thus largely increases the productivity of the chip resistors and allows a plurality of types of chip resistors to be produced from a single type of the chip resistance substrate through adjustment of the removal amount of the resistance film. Accordingly, it is not necessary to design the chip resistance substrate for each resistance value, nor control manufacture and inventory of a considerable number of types of chip resistance substrates. Moreover, when a plurality of types of grooves having different widths are formed on a single chip resistance substrate, chip resistors each having a different resistance can be manufactured from a single chip resistance substrate.

While the removal width of the resistance film is controlled in accordance with the desired resistance value, the insulating substrate can be divided into discrete pieces having a size in conformity with a chip resistor standard. Thus, a production line that complies with the standard can be used without additional adjustment, which is advantageous in view of economy.

When a silicone substrate coated with oxide film is employed as the insulating substrate, cutting can be more efficiently carried out. Also, as cutting the back of the silicone insulating substrate is easy, a chip resistance substrate having a desired thickness can be produced.

DETAILED DESCRIPTION OF PREFERRED EMBODIMENT

Figure 1:
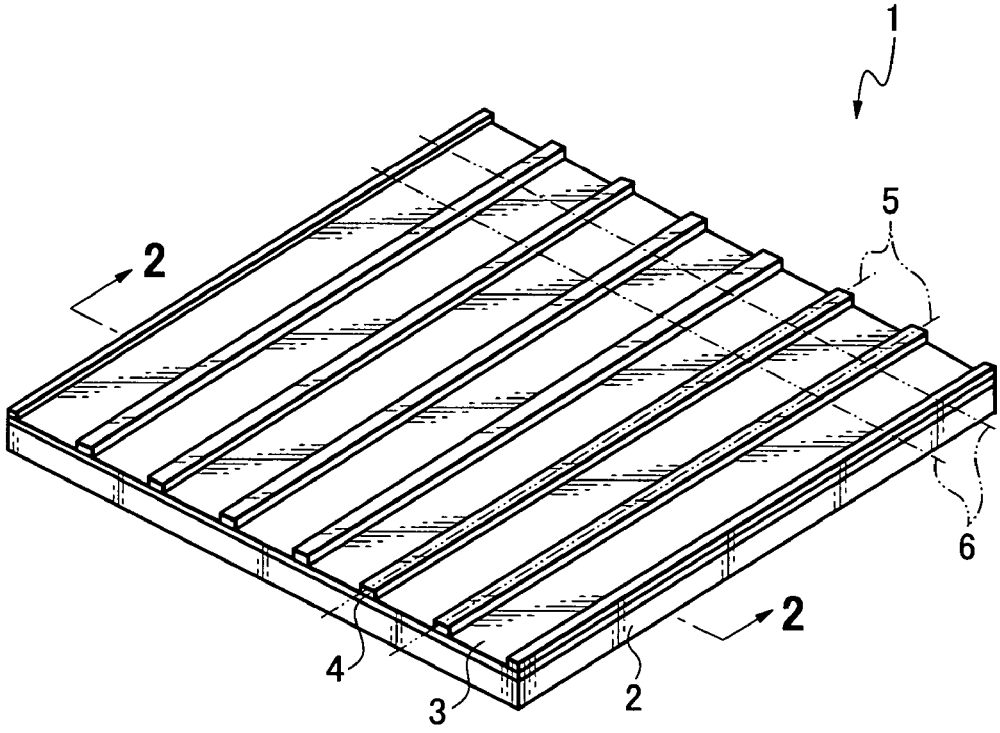
FIG. 1 is a perspective view illustrating an example of a chip resistance substrate.
Figure 2:
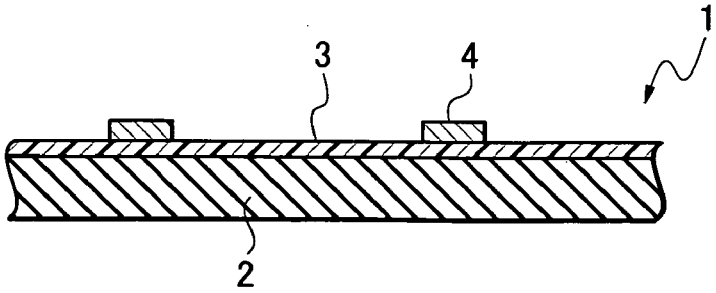
FIG. 2 is a partial cross-sectional enlarged view of the chip resistance substrate taken along a line 2-2 in FIG. 1.

A chip resistance substrate 1 shown in FIGS. 1 and 2 includes an insulating substrate 2 made from an insulator such as alumina ceramics, resistance film 3 formed on the surface of the insulating substrate 2, and a plurality of conductive strips 4 having a required width and disposed at fixed intervals. The material of the insulating substrate 2 is not limited to an insulator, but may be a silicone substrate coated with oxide film.

The chip resistance substrate 1 is divided into discrete chip resistors by severing the substrate 1 in longitudinal and lateral directions. The severing is made along first prescribed severing lines 5 and second prescribed severing lines 6 perpendicular to the first prescribed severing lines 5. Each of the first prescribed severing lines 5 is disposed in such a position as to divide the corresponding conductive strip 4 into two equal parts, while the second prescribed severing lines 6 are positioned in correspondence with the width of the chip resistor to be manufactured.

An example in which a chip resistor is manufactured using a cutting device 10 shown in FIG. 3, for example, is hereinafter described.

Figure 3:
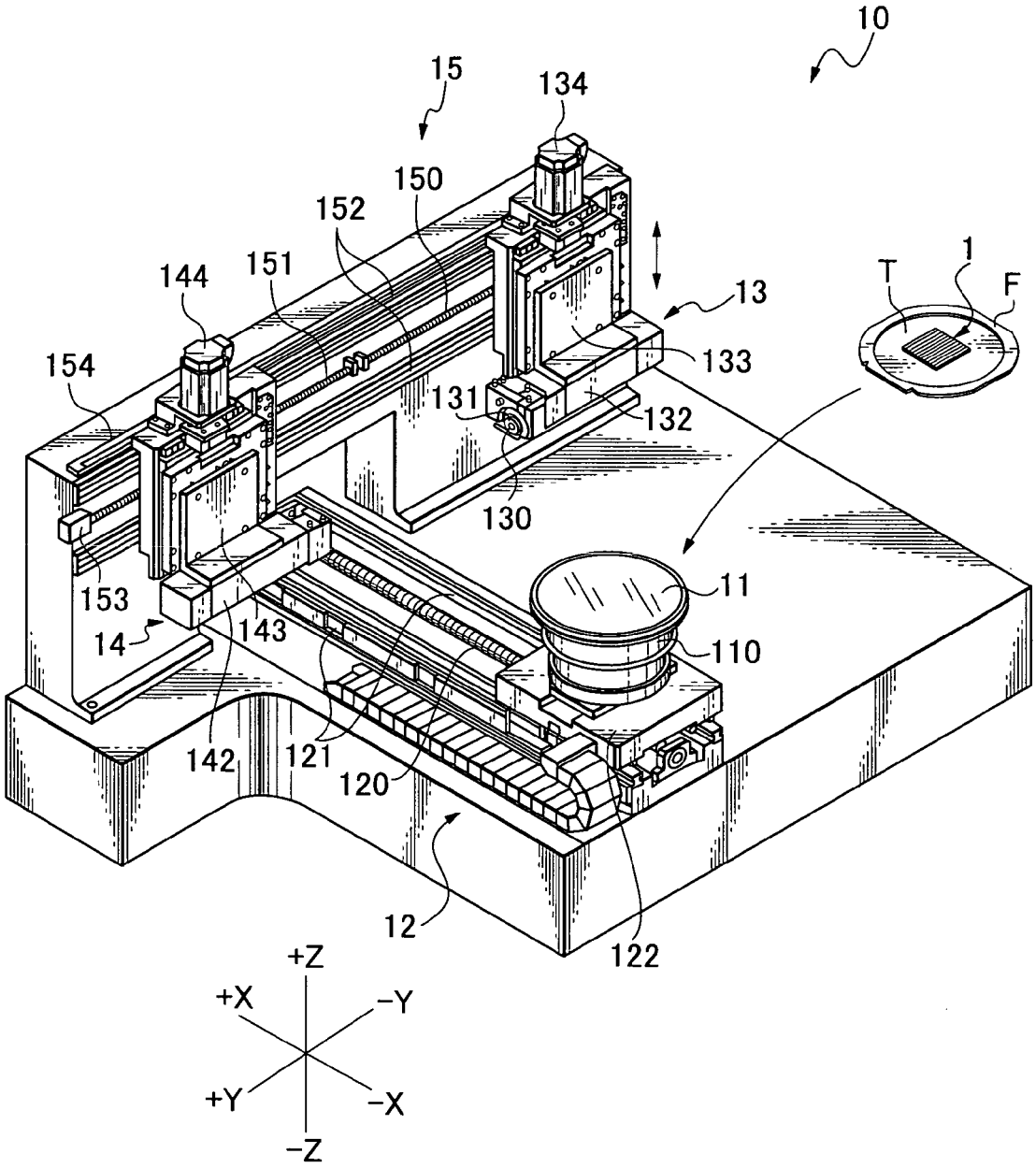
FIG. 3 is a perspective view illustrating an example of a cutting device used in carrying out the method according to the invention.

The cutting device 10 shown in FIG. 3 includes a chuck table 11 for holding a workpiece, an X-axis direction driving unit 12 for driving the chuck table 11 in an X-axis direction, a groove forming unit 13 and a severing unit 14 for cutting the workpiece held by the chuck table 11, and a Y-axis direction driving unit 15 for driving the groove forming unit 13 and the severing unit 14 in a Y-axis direction. That is, the chuck table 11, the groove forming unit 13 and the severing unit 14 are relatively movable by means of the X-axis direction driving unit 12 and the Y-axis direction driving unit 15.

The chuck table 11 is not only movable in the X-axis direction by the X-axis direction-driving unit 12, but also rotatable by a rotational driving unit 110. The X-axis direction driving unit 12 includes a ball screw 120 and guide rails 121 both disposed in the X-axis direction, a servomotor (not shown) connected to one end of the ball screw 120 for rotating the ball screw 120, and a moving base table 122 inside which a nut (not shown) for engaging with the ball screw 120 is provided so as to be shifted in the X-axis direction by the rotational motion of the ball screw 120 while being guided by the guide rails 121.

In the groove-forming unit 13, a first cutting blade 131 having a predetermined width is attached to a tip of a spindle 130 disposed in the Y-axis direction. The first cutting blade 131 revolves with the rotation of the spindle 130. A spindle housing 132 for rotatably supporting the spindle 130 is fixed to an elevating plate 133, whereby the spindle 130 and the first cutting blade 131 can move up and down with the ascending and descending motion of the elevating plate 133 which is driven by a pulse motor 134.

In the severing unit 14, a second cutting blade 141 used for severing (not shown in FIG. 3 but illustrated in FIG. 7) is attached to a tip of a spindle 140 (not shown in FIG. 3 but illustrated in FIG. 7) disposed in the Y-axis direction. The second cutting blade 141 revolves with the rotation of the spindle 140. A spindle housing 142 for rotatably supporting the spindle 140 is fixed to an elevating plate 143, whereby the spindle 140 and the second cutting blade 141 can move up and down with the ascending and descending motion of the elevating plate 143 which is driven by a pulse motor 144.

The Y-axis direction driving unit 15 includes ball screws 150 and 151, guide rails 152 each disposed in the Y-axis direction, a pulse motor (not shown) connected to the ball screw 150 for rotating the ball screw 150, and a pulse motor 153 connected to the ball screw 151 for rotating the ball screw 151. The ball screw 150 engages with a nut provided inside the groove forming unit 13, while the ball screw 151 engages with a nut provided inside the severing unit 14, whereby the groove forming unit 13 and the severing unit 14 are independently shifted in the Y-axis direction by driving of the respective pulse motors while being guided by the guide rails 152. The positions of the groove forming unit 13 and the severing unit 14 in the Y-axis direction are measured by a linear scale 154.

In the cutting device 10, the chip resistance substrate 1 is held by the chuck table 11 in such a mariner as to be integrated with a frame F using a retaining tape T. The groove forming unit 13 shifts in the Y-axis direction with the movement of the chuck table 11 in the X-axis direction, until the chip resistance substrate 1 is positioned directly below the groove-forming unit 13.

Figure 4:
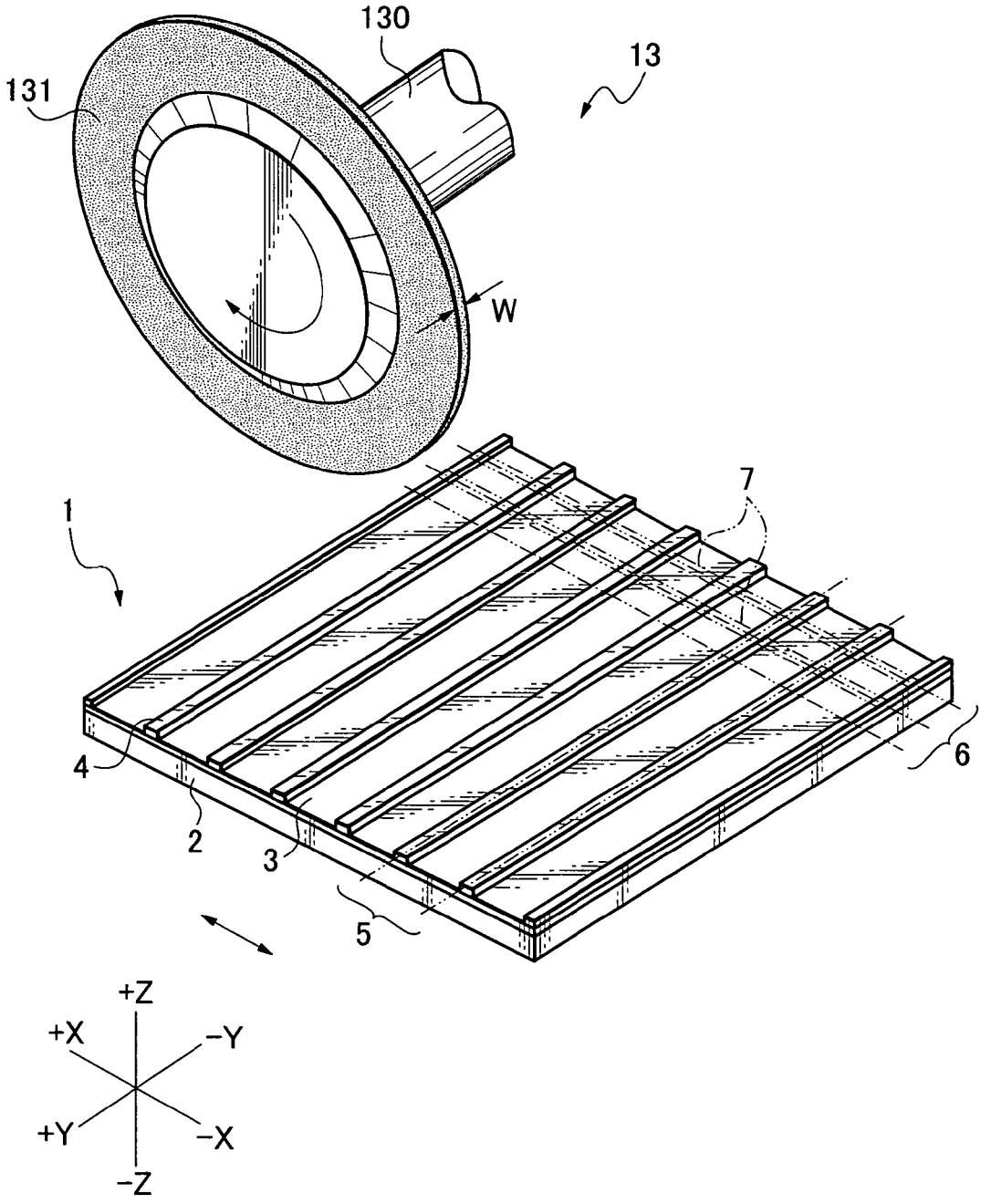
FIG. 4 is a perspective view illustrating a resistance film width adjustment step therein.

Then, the first cutting blade 131, which has a predetermined width W and revolves at a high speed, cuts the chip resistance substrate 1 while reciprocating the chip resistance substrate 1 in the X-axis direction as illustrated in FIG. 4. By relatively moving the chuck table 11 and the groove-forming unit 13 by means of the X-axis driving unit 12 and the Y-axis driving unit 15, respectively, grooves 7 having the predetermined width W are formed. At this stage, the grooves 7 remove the resistance film 3 and the conductive strips 4 including the second prescribed severing lines 6.

Figure 5:
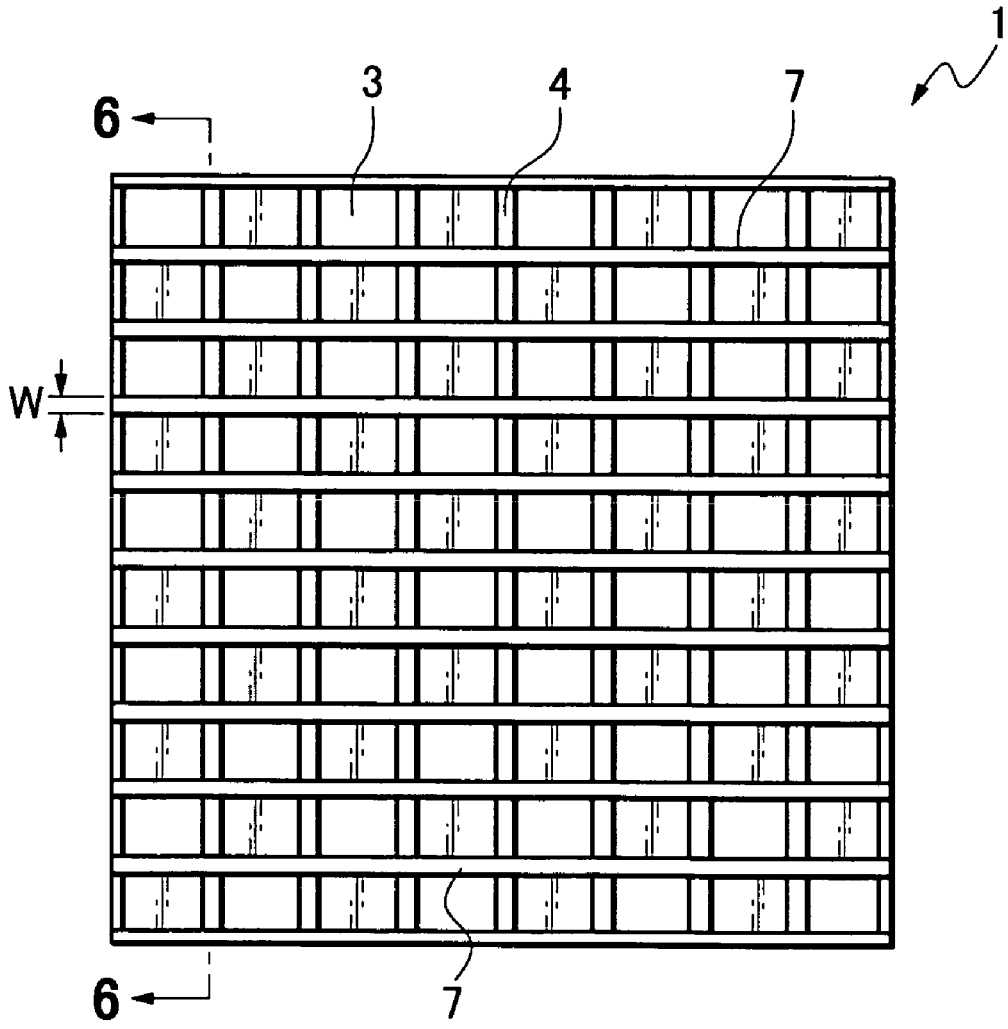
FIG. 5 is a plan view illustrating a chip resistance substrate after the resistance film width adjustment step.

By divisionally shifting the groove-forming unit 13 in the Y-axis direction, a plurality of the grooves 7 are formed in a fixed direction as illustrated in FIG. 5. As a result, the width of the resistance film 3 is adjusted to the predetermined width by the two adjoining grooves 7 (resistance film width adjustment step).

Figure 6:
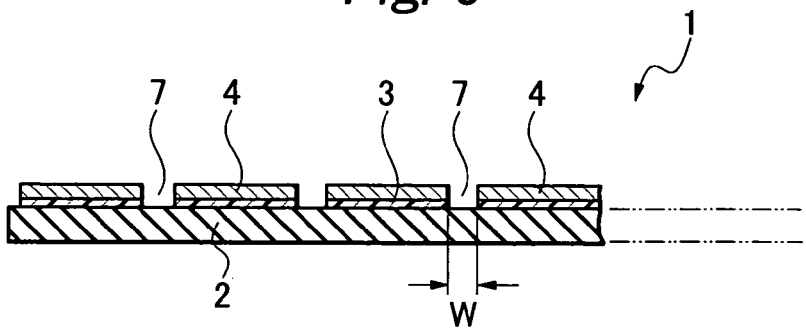
FIG. 6 is a partial cross-sectional enlarged view of the chip resistance substrate taken along a line 6-6 in FIG. 5.

When the grooves 7 are formed by the first cutting blade 131, the cutting depth of the first cutting blade 131 is precisely controlled by the pulse motor 134 shown in FIG. 3. As a result, the resistance film 3 and the conductive strips 4 can be removed as illustrated in FIG. 6.

Figure 7:
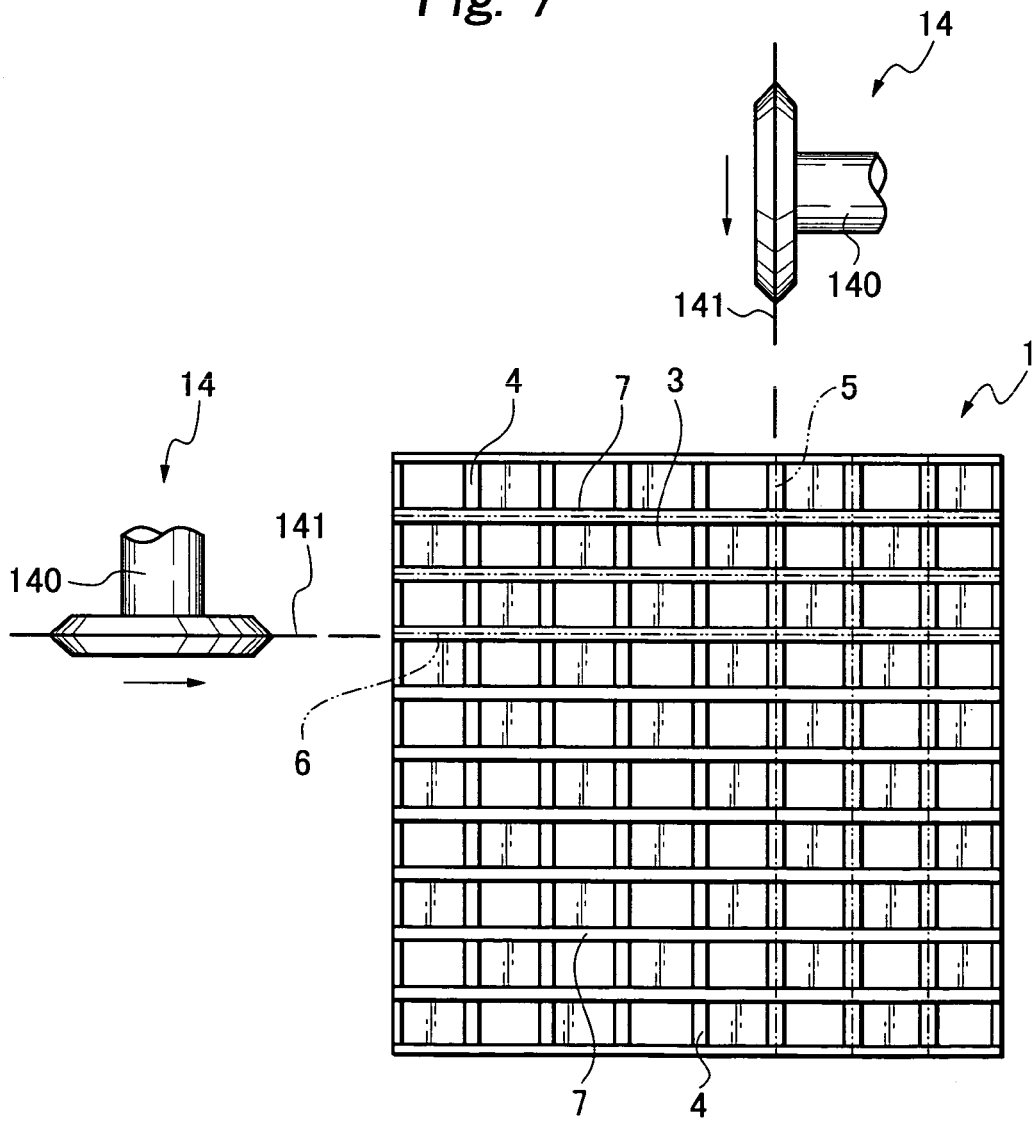
FIG. 7 is a plan view illustrating a division step in the method of the invention.
Figure 8:
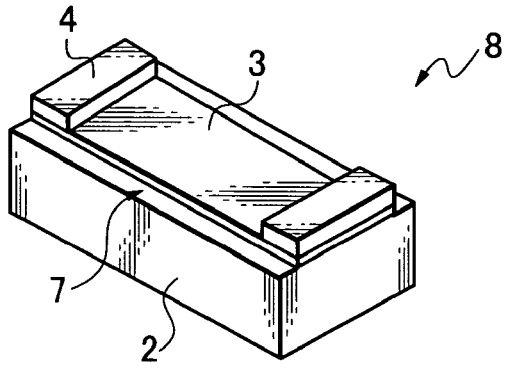
FIG. 8 is a perspective view illustrating an example of a chip resistor manufactured according to the present invention.

In the next step, the chip resistance substrate 1 is severed in longitudinal and lateral directions using the severing unit 14 as illustrated in FIG. 7. First, the second cutting blade 141 used for severing and included in the severing unit 14 is rotated at a high speed to sever the chip resistance substrate 1 along the first prescribed severing lines 5 while relatively shifting the chuck table 11 and the severing unit 14 by means of the X-axis direction driving unit 12 and the Y-axis direction driving unit 15, respectively, and all the first severing lines 5 are cut and severed by the second cutting blade 141. Subsequently, the chuck table 11 (see FIG. 3) is turned 90 degrees and the cutting process is carried out in the same manner. When all of the first and second prescribed severing lines 5 and 6 are severed, a chip resistor 8 shown in FIG. 8 is obtained, for example (division step).

Figure 9:
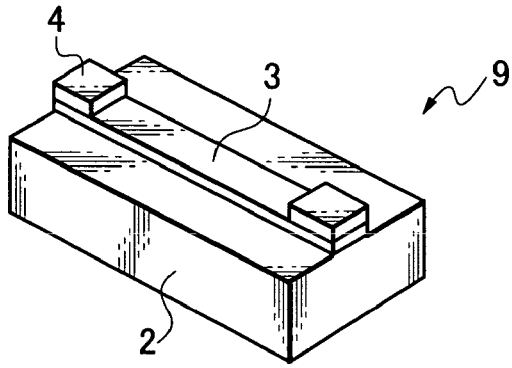
FIG. 9 is a perspective view illustrating another example of a chip resistor manufactured according to the present invention.
Figure 10:
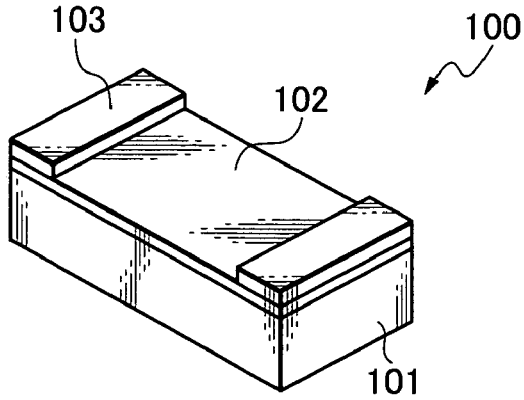
Fig. 10 PRIOR ART
FIG. 10 is a perspective view illustrating a conventional chip resistor.

When cutting is made along the center of the groove 7 in the division step, the chip resistor 8 in which both ends of the resistance film 3 are removed can be produced. The chip resistor 8 having this structure has larger resistance than that of a chip resistor having no groove 7 by the amount corresponding to the removal of the resistance film 3. Additionally, when the width of the grooves 7 is enlarged by reciprocating the chuck table 11 in the X-axis direction several times while shifting the first cutting blade 131 in the Y-axis direction or when the grooves are formed using a first cutting blade having larger width, the removal amount of the resistance film 3 increases and accordingly the width of the resistance film 3 decreases as in a chip resistor 9 shown in FIG. 9. As a result, the resistance value can be further increased.

As described above, the resistance of the chip resistor can be freely and easily controlled through only the adjustment of the width W of the grooves 7 (see FIG. 4) in the resistance film width adjustment step, thereby allowing a plurality of types of the chip resistors to be produced from a single type of the chip resistance substrate. Accordingly, it is unnecessary to design the chip resistance substrate for each resistance value and keep a considerable number of types in stock. Also, control in manufacture is facilitated and thus the manufacturing efficiency is enhanced. Moreover, since resistance values of a plurality of chip resistors can be collectively controlled without requiring resistance adjustment for each chip resistor, the productivity is greatly increased.

Not all grooves formed on a single chip resistance substrate are required to have the same width. When grooves having different widths are formed on a single chip resistance substrate, the resistance film to be included in the final chip resistor will have different widths. It is thus possible to manufacture a plurality of types of chip resistors each having different resistance from a single chip resistance substrate.

While the width of the resistor film included in the chip resistor is controlled in accordance with the desired resistance value as described above, the insulating substrate 2 can be divided into discrete pieces having a size in conformity with a chip resistor standard. Thus, a production line that complies with the standard can be used without additional adjustment, which is advantageous in view of economy.

In this embodiment, the cutting device includes both the groove forming unit and the severing unit. However, these units may be separately provided in two different devices.

When the insulating substrate 2 is made from alumina ceramics or other material having high hardness, severing by the cutting blade is difficult and a laser beam is employed for the severing using a laser beam machine in some cases. However, when a silicone substrate coated with oxide film is used as the insulating substrate 2, severing by the cutting blade can be easily carried out. It is also advantageous in an economical aspect to use the silicone substrate when the silicone substrate is what is to be discarded. Additionally, as cutting the back of the silicone insulating substrate is easy, a chip resistor having a desired thickness can be easily produced.

As aforementioned, the method of manufacturing a chip resistor according to the present invention can be adopted in manufacturing chip resistors having different resistance values with enhanced efficiency.

While a particular embodiment of the invention has been shown and described in detail, the scope and spirit of the invention should not be limited by the particular embodiment and specific constitutions described herein. It is thus obvious that changes and modifications of the invention may be made without departing from the scope of the invention.

What is claimed is:

1. A method of manufacturing a chip resistor by dividing a chip resistance substrate which includes an insulating substrate, resistance film formed on a surface of the insulating substrate, and a plurality of conducting strips for partitioning the resistance film at required intervals, wherein:

prior to a division step in which the chip resistance substrate is severed in longitudinal and lateral directions along first prescribed severing lines to divide the conductive strips into two parts and second prescribed severing lines perpendicular to the first prescribed severing lines so as to form discrete chip resistors, a resistance film width adjustment step is carried out in which grooves are formed by removing a predetermined width of the resistance film including at least the second prescribed severing lines so as to adjust the width of the resistance film by the two adjoining grooves;

in the resistance film width adjustment step, a cutting device is used which includes at least a chuck table for holding a workpiece, a groove forming unit containing a cutting blade which has the predetermined width and cuts the workpiece held by the chuck table, and driving units for relatively shifting the chuck table and the groove forming unit; and the width of the resistance film is adjusted by removing at least the resistance film including the second prescribed severing lines by means of the cutting blade while relatively shifting the chuck table holding the chip resistance substrate and the groove-forming unit by means of the driving units.

2. A method of manufacturing a chip resistor according to claim 1, wherein:

in the division step, a cutting device is used which includes at least a chuck table for holding a workpiece, a severing unit containing a cutting blade which cuts and severs the workpiece held by the chuck table, and driving units for relatively shifting the chuck table and the severing unit; and the chip resistance substrate held by the chuck table after the resistance film width adjustment step is severed along the first prescribed severing lines and the second prescribed severing lines by means of the cutting blade so as to be divided into discrete chip resistors while relatively shifting the chuck table and the severing unit by means of the driving units.

3. A method of manufacturing a chip resistor according to claim 1, which uses a cutting device including at least a chuck table for holding a workpiece, a groove forming unit containing a first cutting blade which has the predetermined width and cuts the workpiece held by the chuck table, a severing unit containing a second cutting blade which cuts and severs the workpiece, and driving units for relatively shifting the chuck table, the groove forming unit and the severing unit, wherein:

in the resistance film width adjustment step, the width of the resistance film is adjusted by removing at least the resistance film including the second prescribed severing lines by means of the first cutting blade while relatively shifting the chuck table holding the chip resistance substrate and the groove forming unit by means of the driving units;

in the division step, the chip resistance substrate held by the chuck table after the resistance film width adjustment step is severed along the first prescribed severing lines and the second prescribed severing lines by means of the second cutting blade so as to be divided into discrete chip resistors while relatively shifting the chuck table and the severing unit by means of the driving units.

4. A method of manufacturing a chip resistor according to claim 1, wherein the insulating substrate is made from a silicone substrate coated with oxide film.

5. A method of manufacturing a chip resistor according to claim 1, wherein the resistance film having a plurality of different widths is formed on a single chip resistance substrate in the resistance film width adjustment step.

* * * * *